US010470529B2

(12) United States Patent
Chan

(10) Patent No.: US 10,470,529 B2
(45) Date of Patent: Nov. 12, 2019

(54) MAGNET HOOK

(71) Applicant: Duraflex Hong Kong Limited, Hong Kong (CN)

(72) Inventor: Yick Fai Chan, Hong Kong (CN)

(73) Assignee: Duraflex Hong Kong Limited, Hong Kong (CN)

( * ) Notice: Subject to any disclaimer, the term of this patent is extended or adjusted under 35 U.S.C. 154(b) by 253 days.

(21) Appl. No.: 15/628,871

(22) Filed: Jun. 21, 2017

(65) Prior Publication Data

US 2018/0368533 A1 Dec. 27, 2018

(51) Int. Cl.
*A44B 11/25* (2006.01)
*A45C 13/10* (2006.01)

(52) U.S. Cl.
CPC ..... *A44B 11/2592* (2013.01); *A45C 13/1069* (2013.01); *A44B 11/2588* (2013.01); *A44D 2203/00* (2013.01)

(58) Field of Classification Search
CPC ..... A44B 11/2592; A44B 11/2596; A44B 11/2588; A45F 5/02; A45C 13/1069; A44D 2203/00
See application file for complete search history.

(56) References Cited

U.S. PATENT DOCUMENTS 3,293,714 A * 12/1966 Shafer ..... A44B 11/2596 24/303
3,657,775 A * 4/1972 Hancock ..... A44B 11/2592 24/312
4,839,948 A * 6/1989 Boros ..... A43B 1/0054 24/303
6,292,985 B1 9/2001 Grunberger
6,467,136 B1 * 10/2002 Graham ..... A44B 11/2592 24/31 R
6,505,385 B2 1/2003 Grunberger
7,377,128 B1 * 5/2008 Zucker-Pinchoff ..... A44B 11/2592 24/265 BC (Continued)

FOREIGN PATENT DOCUMENTS

CN 104853636 A 8/2015
EP 2 468 124 A2 6/2012

OTHER PUBLICATIONS

International Search Report and Written Opinion of the International Searching Authority of PCT/CN2018/086664 dated Jun. 27, 2018.

*Primary Examiner* — Robert Sandy
*Assistant Examiner* — Louis A Mercado
(74) *Attorney, Agent, or Firm* — Collard & Roe, P.C.

(57) ABSTRACT

An attachment assembly has a hook component and a bracket component to which the hook component is removably attached. The hook component has a base body, a hook element attached to the base body, an attachment device for attaching an item to the hook component, and a first magnet connected to the hook element. The bracket component has a base surface, a front surface, and a hook-supporting strut between the base surface and the front surface. The bracket component has a second magnet connected to the base surface. Inserting the hook element in a space between the base surface and the front surface causes the magnets to attract each other and force the hook element through the space to rest on the hook-supporting strut.

10 Claims, 5 Drawing Sheets

(56) References Cited

U.S. PATENT DOCUMENTS

| | | | | |
|---|---|---|---|---|
| 8,171,605 | B2 * | 5/2012 | Schultz | A44B 11/22 24/163 R |
| 8,430,434 | B2 * | 4/2013 | Fiedler | A44B 11/258 292/251.5 |
| 8,850,670 | B2 * | 10/2014 | Fiedler | A44B 11/2592 24/303 |
| 8,857,019 | B1 | 10/2014 | Nykoluk | |
| 9,307,808 | B1 | 4/2016 | Lill | |
| D770,327 | S * | 11/2016 | Chan | D11/216 |
| 9,516,923 | B2 * | 12/2016 | Capra | A44B 11/25 |
| 9,572,410 | B2 * | 2/2017 | Fiedler | A44B 11/258 |
| 9,677,581 | B2 * | 6/2017 | Tucholke | F16B 1/00 |
| 9,700,102 | B2 * | 7/2017 | McCleary | A44B 11/2588 |
| 9,877,549 | B2 * | 1/2018 | Perkins | A44B 17/0011 |
| 9,907,367 | B2 * | 3/2018 | Paik | A41F 1/002 |
| 9,936,772 | B2 * | 4/2018 | Paik | A44B 11/2592 |
| 10,206,461 | B1 * | 2/2019 | Swetish | F16B 1/00 |
| 2012/0255144 | A1 | 10/2012 | Gaudillere et al. | |
| 2015/0135486 | A1 | 5/2015 | Fiedler et al. | |

* cited by examiner

MAGNET HOOK

BACKGROUND OF THE INVENTION

1. Field of the Invention

This invention relates to a hook that is held in place by a magnetized bracket. In particular, the invention relates to a hook and bracket where each of the hook and bracket are equipped with magnets to keeps the two parts connected together.

2. The Prior Art

It is often desirable to removably attach an item to an article of clothing or luggage. Hooks can be used to accomplish this task, with the hook element connecting to a bracket on the clothing or luggage, and with the accessory being attached to the hook via webbing. One drawback of this arrangement is that the hook can often be difficult to attach if the underlying fabric holding the bracket is very soft. Attempts to push the hook through the bracket succeed only in moving the fabric with not attachment of the hook. In addition, the hook can sometimes become disengaged due to lateral forces on the hook, resulting in loss of the accessory.

Magnets can be used in closure elements to assist in the connection of the two parts together, and to add to the security of the closure. For Example, U.S. Pat. Nos. 6,292,985 and 6,505,385 to Grunberger discloses a magnetic closure in which each of the two parts has a magnet. The attraction of the magnets to each other assists in connecting the two parts together, and extra force is needed to overcome the attraction of the magnets. The drawback of this design however, is it is not suitable for heavy loads and high forces, as the two parts can become disengaged quite easily.

SUMMARY OF THE INVENTION

It is therefore an object of the invention to devise mechanism that can attach heavy articles to luggage, clothing or other items, which is resistant to forces from all directions, and which can be attached and removed with a single hand.

These and other objects are accomplished by an attachment assembly having a hook component and a bracket component to which the hook component is removably attached. The hook component has a base body, a hook element attached to the base body, an attachment device for attaching an item to the hook component, and a first magnet connected to the hook element. The bracket component has a base surface, a front surface, and a hook-supporting strut between the base surface and the front surface. The bracket component has a second magnet connected to the base surface. Inserting the hook element in a space between the base surface and the front surface causes the magnets to attract each other and force the hook element through the space to rest on the hook-supporting strut.

The attachment device on the hook component can be a strap retaining bar extending across an opening in the hook component. The strap can be attached to an item at one end and to the strap retaining bar at the other end so that the item can be connected to the hook component and eventually the bracket component via the hook. This way, when the bracket component is permanently fixed to an article such as luggage or clothing, the item is removably attached to the article via inserting the hook element into the bracket component.

To facilitate retention of the hook element by the bracket component, the hook element has a curved end portion that grips an edge of the hook-supporting strut when the hook component is secured to the bracket component. The hook element also has a generally curved outer contour, which helps the hook element slide into the space in the bracket component. The walls of the bracket component are generally rounded as well, to enable better sliding of the hook element into the opening.

The magnets are preferably of the same size and shape. The first magnet is preferably embedded in the hook element and the second magnet is embedded in the base surface. When the hook component is fully connected to the bracket component, the magnets overlap each other and but are offset from each other so as to be not entirely superimposed. This way, the force from magnetic attraction continuously forces the hook element through the space to prevent inadvertent disengagement of the hook element. The magnets can be attached to the components by either force fit or adhesive.

To attach the bracket component to an object such as luggage or clothing, a back plate is used, wherein the luggage or clothing is placed between the bracket component and the back plate, and the bracket component and back plate are then connected together. In one embodiment, the bracket component has at least one locking flange extending away from the base surface in a direction opposite to the hook-supporting strut. The locking flange is made up of a leg extending away from the base surface, and a locking plate extending parallel to the base surface, the locking plate having a width and length that is greater than a width and length of the leg. The back plate has a top surface and a supporting rim that elevates the top surface. There is at least one opening in the top surface. The opening has a first portion with a length at least as large as the length of the locking surface, and a second portion with a length at least as large as the length of the leg but smaller than the length of the locking plate. The bracket component is adapted to be locked to the back plate by placing the locking plate through the first portion of the opening and sliding the bracket component until the locking flange extends through the second portion. Since the second portion is smaller than the length of the locking plate, the bracket component cannot be separated from the back plate without sliding the locking flange back to the first portion of the opening.

Preferably, there are two locking flanges on the bracket component, and two openings in the back plate. The second opening can extend to an edge of the back plate and open into the edge, so that the second opening can be the size of the second portion of the first opening. The second locking flange can be inserted into the second opening by sliding the locking flange into the opening from the edge of the back plate.

To keep the bracket component from being inadvertently disengaged from the back plate, the back plate can have a spring mounted underneath at least one of the openings. The spring exerts upward pressure on the locking plate when the bracket component is being inserted into the opening in the back plate, and snaps back into an unloaded position when the locking plate is slid into the second portion. The spring then abuts the locking plate and prevents any sliding of the locking plate back into the first portion of the opening.

To further secure the back plate to the bracket component, either the back plate or bracket component (or both) can be equipped with a plurality of protrusions that dig into the other component to prevent sliding of the two components relative to each other. To assemble the back plate and bracket component onto an article of clothing or luggage, the clothing or luggage is equipped with holes or slits through which the locking flange of the bracket component is placed. Then, the locking flange is locked to the back plate, to lock these components to each other and to the article.

The assembly according to the present invention, due to the secure attachment to the article by the backplate, the curved structure of the hook, and the forces created by the magnets makes it very simple to attach the hook component to the bracket component using only a single hand. The user can attach the hook simply by feel and does not need to visualize the assembly during use. The present invention eliminates the difficulties in trying to attach a length of webbing directly to an article, which can be cumbersome, or to attach a hook onto a loop of webbing, which usually takes two hands due to the softness of the webbing. Due to the magnetic attraction and the shape of the hook element, the hook element "snaps" into place in the locked position, giving an audible indication that the hook element is fully inserted into the bracket component.

To disengage the hook component from the bracket component, the hook is simply pulled out of the opening in the bracket component. This can be done with a single hand. As this direction of motion is perpendicular to the direction of magnetic force of the magnets, it is not difficult to break the magnetic attraction and release the hook from the locked position. At a certain point in the release, the same poles of the magnets approach each other and serve to further repel the hook element out of the opening.

The present invention is particularly useful for bags, such as rucksacks, backpacks, handbags or briefcases, and also has use in military wear, business apparel and hiking and skiing apparel. The components are molded of rigid plastic, which provide sufficient structure to allow the hook component to be engaged and disengaged from the bracket component using a single hand and without looking at the components.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
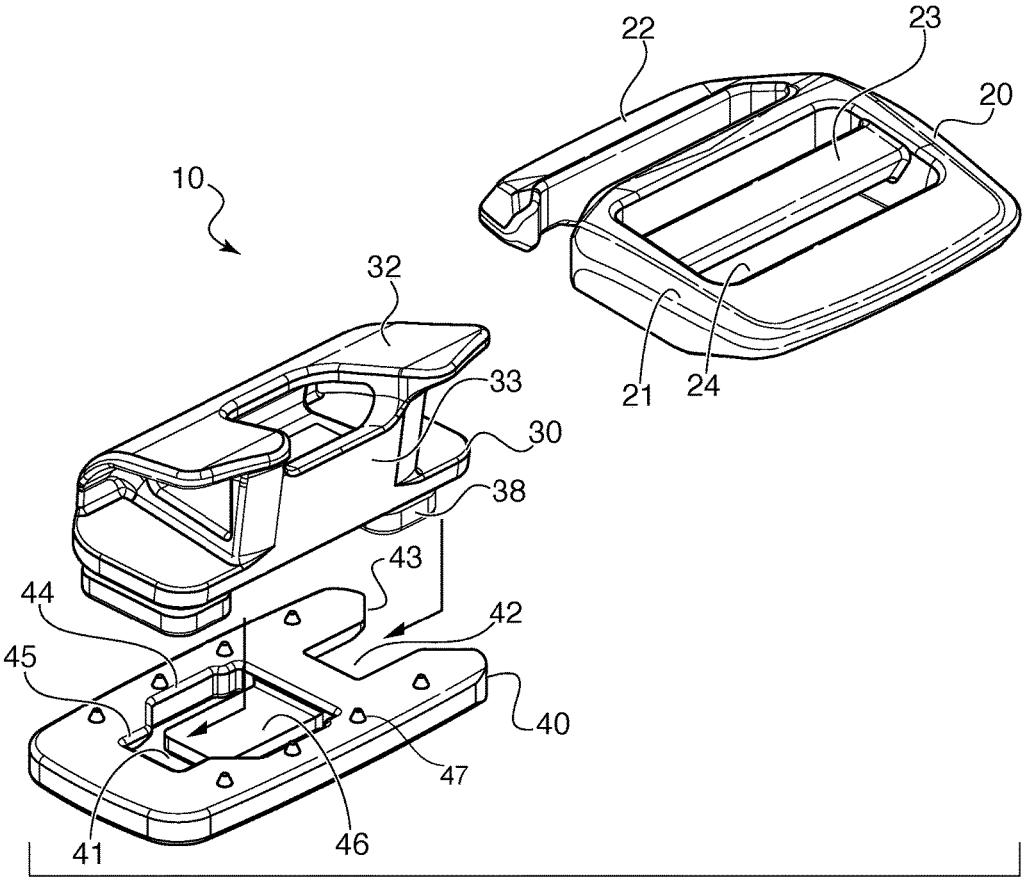
FIG. 1 shows an exploded view of the components of the attachment system according to the invention.
Figure 2:
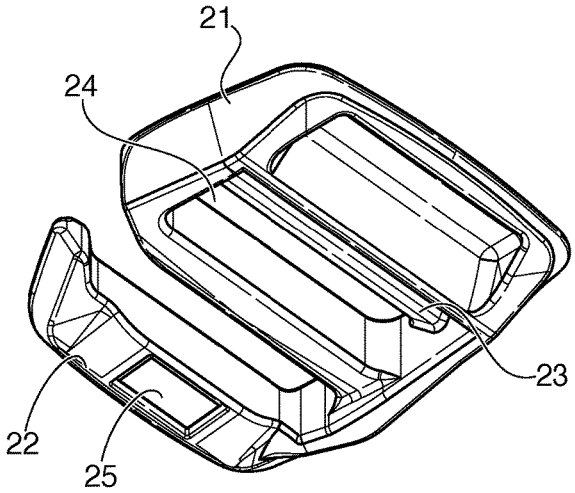
FIG. 2 shows a perspective view of the bottom of the hook component according to the invention.
Figure 3:
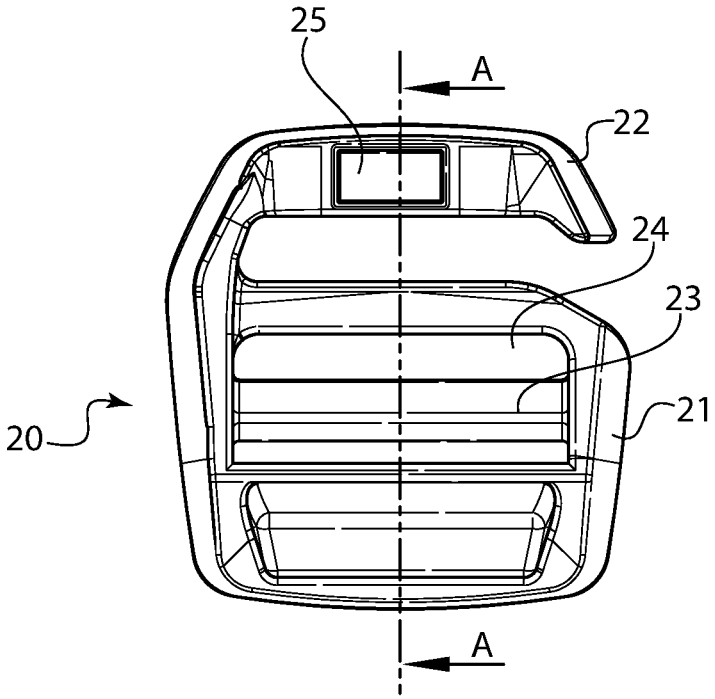
FIG. 3 shows a bottom view of the hook component.
Figure 4:
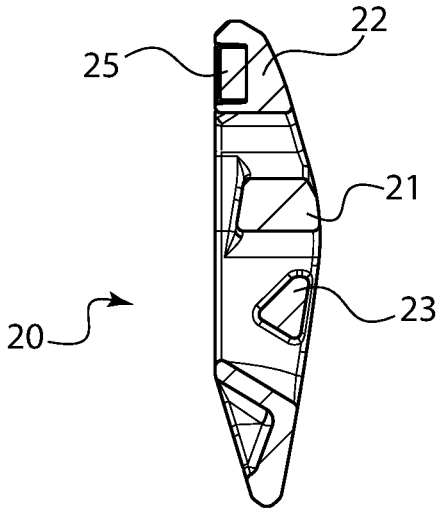
FIG. 4 shows a cross-sectional view along lines A-A of FIG. 3.

Referring now in detail to the drawings and, in particular, FIG. 1 shows an exploded view of the attachment assembly 10 according to the invention. Attachment assembly 10 comprises a hook component 20, a bracket component 30 and a back plate 40. Hook component 20 has a base body 21 and a hook element 22. Extending across base body 21 and spanning an aperture 24 is a strap retaining bar 23 for retaining a strap that is wrapped around bar 23 and secured, either by a sliding buckle or by sewing.

Figure 5:
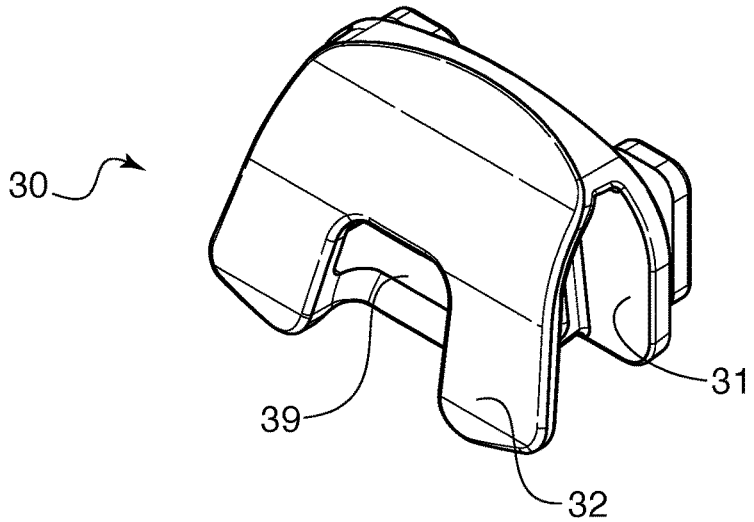
FIG. 5 shows a perspective view of the bracket component according to the invention.
Figure 6:
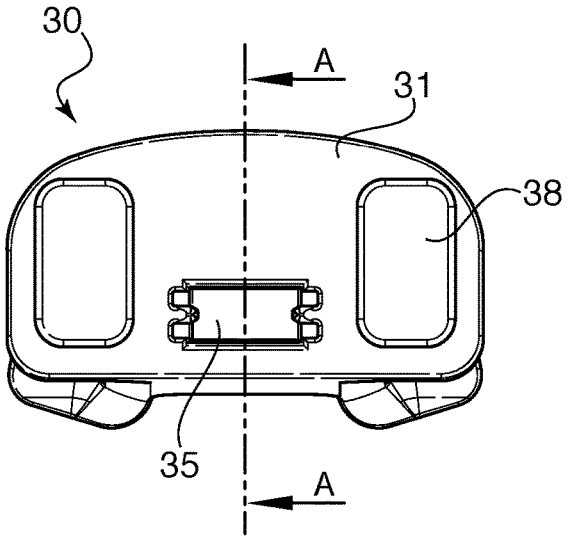
FIG. 6 shows a rear view of the bracket component.
Figure 7:
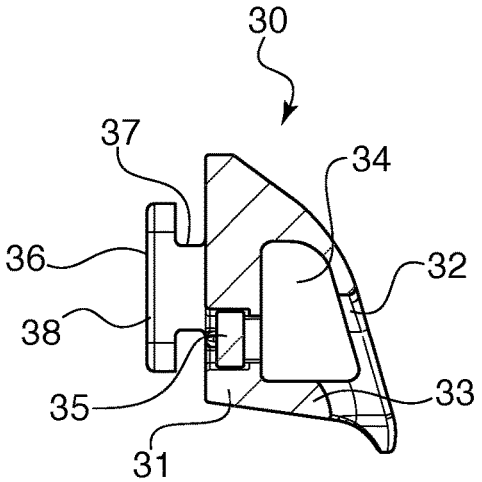
FIG. 7 shows a side cross-sectional view along lines A-A of FIG. 6.

Embedded in hook element 22 is a magnet 25. Magnet 25 can be secured by snap fit or by adhesive. The end of hook element 22 is curved downward to help secure hook element 22 on bracket component 30, such as shown in FIGS. 5-7. Bracket component 30 has a base surface 31, a front surface 32, and a hook-supporting strut 33 between the base surface 31 and the front surface 32. The structure of the base and front surfaces and the strut 33 forms a channel 34 for receiving the hook element 22. There is a second magnet 35 connected to the base surface 31. Second magnet 35 can be embedded in base surface 31 and secured there by snap fit, adhesive or any other suitable way.

The bracket component 30 has two locking flanges 36 extending away from the base surface 31 in a direction opposite to the hook-supporting strut 33. Each locking flange 36 has a leg 37 and a locking surface 38. The locking surface 38 has a width and length that is greater than a width and length of the leg 37.

Located on the front surface 32 is an indentation 39. This indentation 39 assists the user in placing hook element 22 through channel 34, because the user can rest their thumb in indentation 39 for leverage while sliding the hook element 22 through channel 34.

Figure 9:
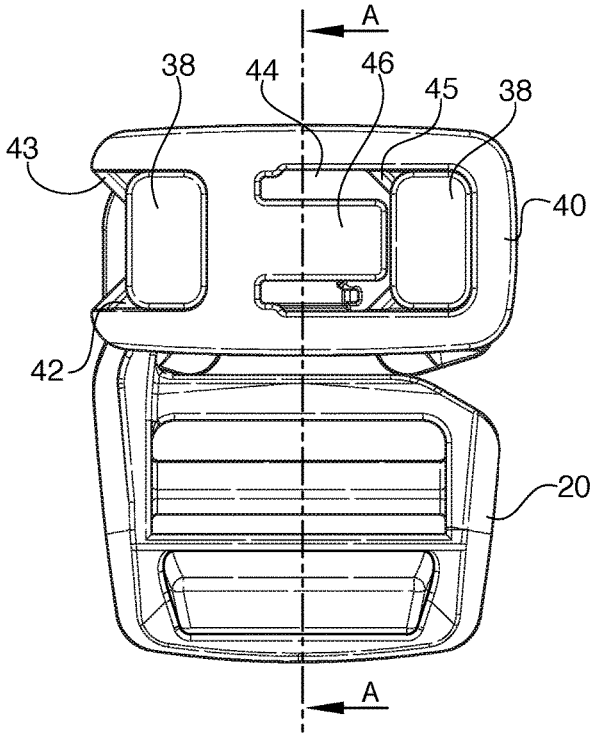
FIG. 9 shows a rear view of the assembly.

As shown in FIGS. 1 and 9, bracket component 30 can be mounted to a back plate 40. Back plate 40 has an opening 41 and a slot 42. Slot 41 has a wider section 44, which is sized to accommodate the insertion of locking surface 38, and a smaller section 45, which is smaller in length than locking plate 38, so that locking surface 38 can be inserted through wider section 44 and slid over to smaller section 45 to lock bracket component 30 to back plate 40. Similarly, slot 42 has a wide chamfered area 43, opening into the side of back plate 40, to receive the other locking surface 38. Once the bracket component 30 is slid over so that it is flush with back plate 40, i.e., to the right in FIG. 9, locking surface 38 is held in place by the smaller size of slot 42. To further lock bracket component 30 to back plate 40, a spring 46 is disposed in slot 41. Spring 46 can bend downward to yield to locking surface 38 as it is inserted into the wider section of slot 41, but then springs back into a rest position once bracket component 30 is slid into a locking position where locking flange 36 is over the smaller section of slot 41, as shown in FIG. 9. As can be seen there, spring 46 then abuts locking surface 38 and prevents any rearward motion of bracket component 30 and thus prevents any accidental unlocking of bracket component 30 from back plate 40.

To further secure the back plate 40 to the bracket component 30, either the back plate 40 as shown or bracket component 30 (or both) can be equipped with a plurality of protrusions 47 that dig into the other component to prevent sliding of the two components relative to each other.

Back plate 40 can be used to connect bracket component 30 to an article such as luggage or clothing. To do this, the luggage or clothing is provided with holes that match the dimensions of locking legs 37. The locking flanges 36 are fed through the holes (not shown) and then attached to back plate 40, which is on the other side of the article. This way, the article is held between back plate 40 and bracket component 30.

Figure 8:
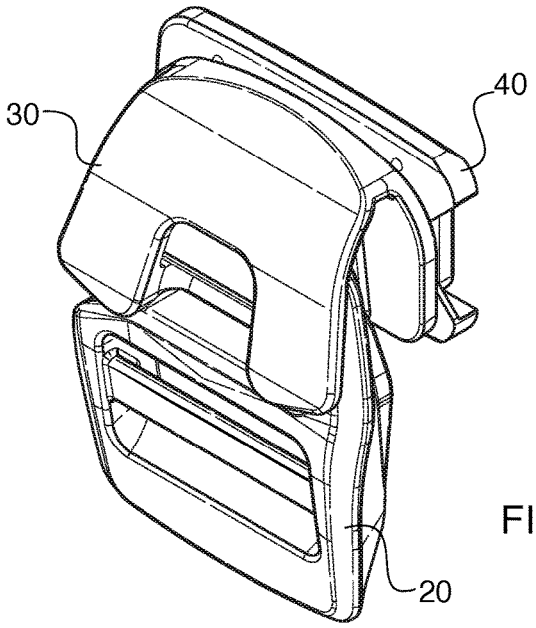
FIG. 8 shows a perspective view of the components of the invention as assembled.
Figure 10:
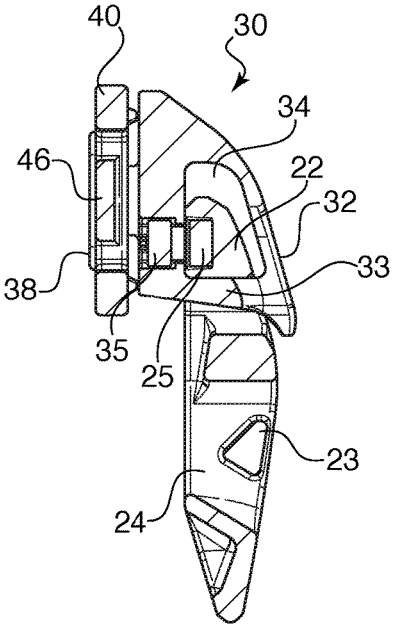
FIG. 10 shows a side-cross-sectional view along lines A-A of FIG. 9.

The fully locked assembly is shown in FIGS. 8-10. Once hook component 20 is connected to bracket component 30 by sliding hook element 22 through channel 34, magnets 25 and 35 attract each other and keep hook element firmly seated in channel 34. The curved end of hook element 22 extends beyond channel 34 and also helps prevent exit of hook component 20 from bracket component 30.

Figure 11:
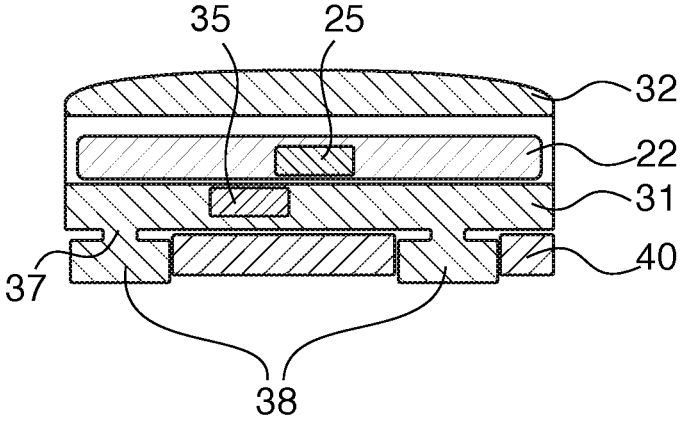
FIG. 11 shows a cross-sectional view along lines B-B of FIG. 8.

As shown in FIG. 11, in the locked position, magnets 25 and 35 overlap, but are slightly offset from each other, so that constant pressure is put on hook element 22 to force it farther into channel 34. Once the wearer starts to remove hook element 22, the magnets disengage, and the magnets can actually repel each other once a certain offset position is reached, to assist in removal of the hook element from channel 34.

Accordingly, while only a few embodiments of the present invention have been shown and described, it is obvious that many changes and modifications may be made thereunto without departing from the spirit and scope of the invention.

What is claimed is:

1. An attachment assembly comprising:

a hook component having a base body, a hook element attached to the base body, an attachment device for attaching an item to the hook component, and a first magnet connected to the hook element, and a bracket component having a base surface, a front surface, and a hook-supporting strut between the base surface and the front surface, the bracket component having a second magnet connected to the base surface, wherein inserting the hook element in a space between the base surface and the front surface causes the magnets to attract each other and force the hook element through the space to rest on the hook-supporting strut, wherein the hook element has a curved end portion that grips an edge of the hook-supporting strut when the hook component is secured to the bracket component, wherein the base body has an opening in a central portion thereof and wherein the attachment device comprises a strap retaining bar extending across the opening.

2. The attachment assembly according to claim 1, wherein the first magnet is embedded in the hook element and the second magnet is embedded in the base surface.

3. The attachment assembly according to claim 1, wherein the hook element has a curved outer edge.

4. The attachment assembly according to claim 1, wherein the magnets overlap each other and are offset from each other when the hook component is attached to the bracket component, so that force from magnetic attraction continuously forces the hook element through the space.

5. The attachment assembly according to claim 1, wherein the magnets are attached to the components by force fit or glue.

6. An attachment assembly comprising:

a hook component having a base body, a hook element attached to the base body, an attachment device for attaching an item to the hook component, and a first magnet connected to the hook element, and a bracket component having a base surface, a front surface, and a hook-supporting strut between the base surface and the front surface, the bracket component having a second magnet connected to the base surface, wherein inserting the hook element in a space between the base surface and the front surface causes the magnets to attract each other and force the hook element through the space to rest on the hook-supporting strut, and wherein the bracket component has at least one locking flange extending away from the base surface in a direction opposite to the hook-supporting strut, the locking flange comprising a leg and a locking plate, the locking plate having a width and length that is greater than a width and length of the leg, and further comprising a back plate having a top surface and a supporting rim, and at least one opening in the top surface, said at least one opening having a first portion with a length at least as large as the length of the locking plate, and a second portion with a length at least as large as the length of the leg but smaller than the length of the locking plate, such that the bracket component is adapted to be locked to the back plate by placing the locking plate through the first portion of the opening and sliding the bracket component until the locking flange extends through the second portion.

7. The attachment assembly according to claim 6, wherein the back plate further comprises a spring mounted underneath the at least one opening, wherein the spring yields to pressure by the locking plate when the bracket component is inserted into the at least one opening, and returns to a rest position and abuts the locking plate when the locking flange is moved to the second portion of the opening, to prevent sliding of the bracket component into the first portion of the opening where the bracket component can be unlocked.

8. The attachment assembly according to claim 6, wherein one of the bracket component and the back plate has a plurality of protrusions thereon, to grip the bracket component or back plate when the bracket component is locked to the back plate.

9. The attachment assembly according to claim 6, wherein there are two locking legs and locking plates, and further comprising a second opening in the back plate.

10. The attachment assembly according to claim 9, wherein the second opening extends to an edge of the back plate.

* * * * *